United States Patent [19]

Ogasawara

[11] Patent Number: 5,075,132

[45] Date of Patent: Dec. 24, 1991

[54] METHOD FOR COATING SUBSTRATES WITH WATER AND OIL BASE PAINTS ON A SINGLE COATING LINE

[75] Inventor: Toshifumi Ogasawara, Hiroshima, Japan

[73] Assignee: Mazda Motor Corporation, Hiroshima, Japan

[21] Appl. No.: 426,409

[22] Filed: Oct. 25, 1989

[30] Foreign Application Priority Data

Oct. 25, 1988 [JP] Japan ..... 63-270562

[51] Int. Cl.[5] ..... B05D 3/02

[52] U.S. Cl. ..... 427/55; 427/407.1; 427/421; 427/388.4; 427/388.5; 427/385.5

[58] Field of Search ..... 427/407.1, 409, 421, 427/424, 55, 314, 318, 385.5, 388.1, 388.4, 388.5

[56] References Cited

U.S. PATENT DOCUMENTS

| | | | |
|---|---|---|---|
| 4,391,858 | 7/1983 | Batzill | 427/409 X |
| 4,455,328 | 6/1984 | Jenkins | 427/409 X |
| 4,812,335 | 3/1989 | Kuwajima et al. | 427/407.1 |
| 4,820,555 | 4/1989 | Kuwajima et al. | 427/407.1 |

*Primary Examiner*—Shrive Beck
*Assistant Examiner*—Alain Bashore
*Attorney, Agent, or Firm*—Fish & Richardson

[57] ABSTRACT

A coating line contains a water paint coating step for forming a coat by coating a substrate with a water paint; a pre-heating step for pre-heating the coat; and a baking step for drying the coat by baking. In the coating line, the substrate coated with an oil base solid paint is further coated with the oil base solid paint in the water paint coating step. The substrate is then transferred to the next step by bypassing the pre-heating step or by passing through the pre-heating step which is not heated by turning a pre-heating device disposed therein OFF. The coating line may be provided with an oil base clear paint coating step to thereby form an oil base clear paint coat yielding a two-layer coat. By coating the oil base solid paint in the clear paint coating step only, a one-layer coat can be given.

In the clear paint coating step, an oil paint can be coated in the coating line which is provided with a second pre-heating step subsequent to the clear paint coating step yet prior to the baking step. In this case, the oil base solid paint is coated in either of the clear base paint coating step or in both, and the coat formed is transferred to the next step by bypassing the second pre-heating step or by passing through the second pre-heating step which is not heated.

23 Claims, 9 Drawing Sheets

METHOD FOR COATING SUBSTRATES WITH WATER AND OIL BASE PAINTS ON A SINGLE COATING LINE

BACKGROUND OF THE INVENTION

1. Field of the Invention

The present invention relates to a coating method and, more particularly, to a coating method in a coating line on which substrates to be coated with a water base paint and substrates to be coated with an oil paint are conveyed simultaneously in a mixed state.

2. Description of Related Art

Generally speaking, outer panels or other outer parts of a vehicle, as an automobile, place great importance on their aesthetic appearance so that they are finished by coating them with a thermosetting paint of a type capable of being diluted with an organic solvent, which can provide a final coat having coat properties superior in a smoothness, a gloss, a weather resistance and so on. They are usually finished in many cases by coating such a thermosetting, transparent, clear paint on an air-dried coat obtained by coating them with a thermosetting enamel paint of a type capable of being diluted with an organic solvent, which contains a color pigment and/or a metallic pigment, and by setting two coats simultaneously.

Recently, however, demands to further improve an appearance on a coat surface of outer panels or other outer parts of the vehicle have been made, together with demands to provide a working environment in which no volatile organic solvents are free. In order to meet with these demands, Japanese Patent Publication (Kokai) No. 193,676 discloses a procedure that such a clear paint is coated on an undercoat obtained by coating a water base paint which is conveniently compatible with the clear coat and contains a hazardous volatile ingredient.

As water base paints have been frequently employed for the purpose as have been described hereinabove, a demand has been made to convey coating substrates to be coated with a water base paint simultaneously with coating substrates to be coated with an oil paint in a mixed state on a coating line. In order to deal with such a demand, however, a unique plan should be elaborated so as to compete with a difference in kinds of solvents contained in the paints to be used for coating substrates with the water base paint and with the oil paint. More specifically, the substrates coated with the water base paint, on the one hand, are required to be heated in a pre-heating step to allow the water in the water base paint to evaporate to an appropriate level of dryness. If the substrates coated with the oil paint, on the other hand, would be conveyed to such a pre-heating step immediately after they have been coated with the oil paint, like the substrates coated with the water base paint, volatile solvents contained in conventional oil base paints are caused to be heated to an excessively high temperature and evaporated, thereby forming a rough surface on the coat and, in a worse case, causing a pinhole on the coat surface. This gives rise to the inapplicability of a conventional coating line to a mixed conveyance of the substrates coated with the water base paint together with those coated with the oil paint.

It is to be noted as a matter of course that such problems could never occur if the substrates coated with the water base paint and those coated with the oil paint would be conveyed in a separate coating line. However, a coating line requires a significantly broad space so that a provision of two coating lines presents practically inapplicable problems, each being provided exclusively for the coating with the water base paint and for the coating with the oil paint.

SUMMARY OF THE INVENTION

Therefore, the present invention has the object to provide a coating method capable of coating substrates with a water base paint and with an oil base solid paint on an identical coating line.

In order to achieve the object, the present invention is such that a coating substrate is coated with an oil base solid paint in a coating step in a coating line designed originally for coating a water base paint.

By appropriately coating a substrate with the oil base solid paint, a pre-heating step can be omitted from the coating line arranged for the water base paint after the coating of the oil base solid paint.

Due to a type of the coating line for coating the water base paint, however, the pre-heating step cannot be avoided after the oil base solid paint has been coated on the substrate. In this case, the pre-heating step can be avoided by arranging the coating line in such a manner that the substrate coated with the oil base solid paint is not substantially heated at a site corresponding to the pre-heating step of the coating line. At this end, the coating line may be arranged such that the substrate coated with the oil base solid paint bypasses the pre-heating site of the coating line and it is transferred to a next step or such that the substrate is not heated at the pre-heating site thereof by suspending operation of a pre-heating device while the substrate passes through the pre-heating site thereof.

A type of coating lines designed originally for coating a water base paint—basically, a coating line—comprises at least a water base pint coating step for forming a coat of the water base paint by coating a substrate with the water base paint, a pre-heating step for heating the coat of the water base paint formed on the substrate, and a baking step for drying the pre-heated coat by baking after the pre-heating step. In this coating line, the oil base solid paint can be coated on the substrate in the water base paint coating step and the substrate coated with the oil base solid paint is transferred to the baking step after its pre-heating step has been bypassed or after it has been passed through the pre-heating step which was not heated by suspending operation of the pre-heating device.

Another type of the coating line designed originally for coating a water base paint comprises a base paint coating step for forming a base coat by coating the substrate with a water base paint, a pre-heating step for heating the base coat formed on the substrate, a clear paint coating step for forming a clear coat by coating the base coat on the substrate with a clear oil paint, and a baking step for drying the base coat and the clear coat by baking. In this coating line, coating an oil base solid paint on the substrate in the clear paint coating step is subject to no adverse influences from the heating in the pre-heating step. However, the oil base solid paint can be coated in the base paint coating step. In this case, the substrate coated with the oil base solid paint in the base paint coating step is then transferred to the baking step by bypassing the pre-heating step of the original coating line or by passing the substrate through the pre-heating step thereof which is not heated.

The present invention can provide an excellent coat by appropriating a dry state of the coat prior to the baking step in any case when the oil base solid paint is coated or when the water base paint is coated.

Other objects, features and advantages of the present invention will become apparent in the course of the description of the preferred embodiments which follow, with reference to the accompanying drawings.

BRIEF DESCRIPTION OF THE DRAWINGS

FIGS. 3, 4, and 5 represent each an example of a pre-heating device of a type of blowing a warm air, in which FIG. 3 is a sectional side view, FIG. 4 is a sectional view taken along the line X5—X5 of FIG. 3, and FIG. 5 is a perspective view showing an overall structure.

FIGS. 6 and 7 are each an example of a pre-heating device of a type of applying far infrared rays, in which FIG. 6 is a front view and FIG. 6 is a brief sectional side view of FIG. 6.

DESCRIPTION OF THE PREFERRED EMBODIMENTS

The present invention will be described in more detail by way of examples with reference to the accompanying drawings.

Figure 1A:
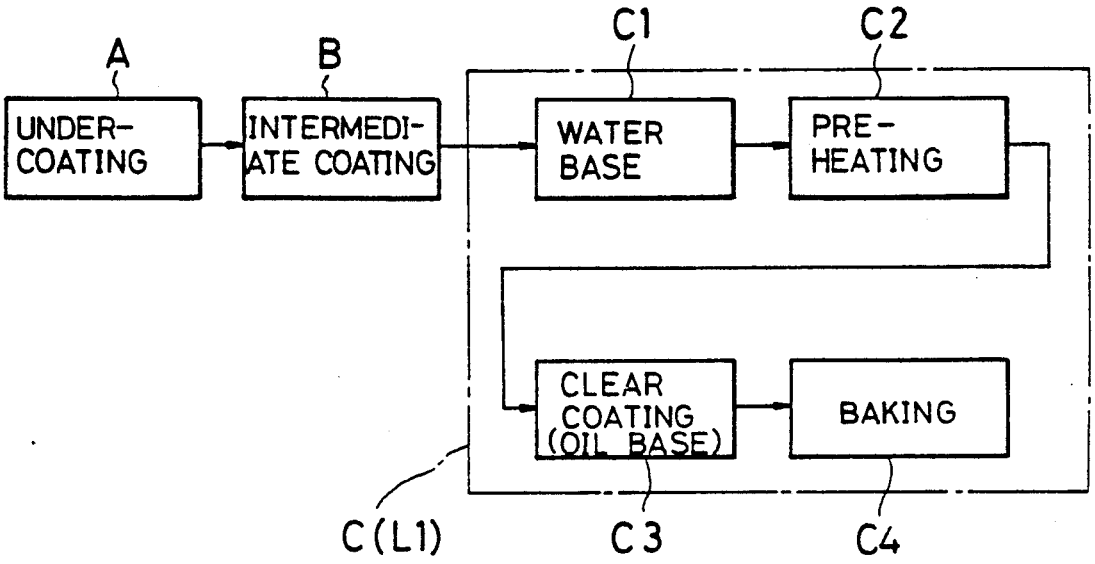
FIGS. 1A, 1B, and 1C are each a block diagram showing a coating line to which the present invention is applicable.

A general method for coating vehicle bodies as a substrate in accordance with steps as shown in FIG. 1A, which comprises an undercoating step A, an intermediate coating (intercoating) step B, and an overcoating step C, with these steps disposed in this order in the direction in which the vehicle bodies are conveyed in a coating line.

The undercoating step A is to coat an undercoat with the purpose of a rust prevention by per se known electrodeposition.

The intermediate coating step B is to coat an intermediate coat or an intercoat with the purpose to adjust a coat surface for improvements in an appearance of a finished overcoat on the substrate by fill up pinholes or irregular portions on the undercoat surface as well as with the purposes to protect an undercoat against an external impact, to prevent a water penetration of water into the undercoat and to improve adhesion of the undercoat on the substrate surface and of the overcoat. The intercoating step B is generally carried out by per se known air spraying or electrostatic coating.

The overcoating step C is to improve an appearance on the finished coat surface of the substrate. This step is generally carried out by spraying.

OVERCOATING STEP C

Figure 1B:
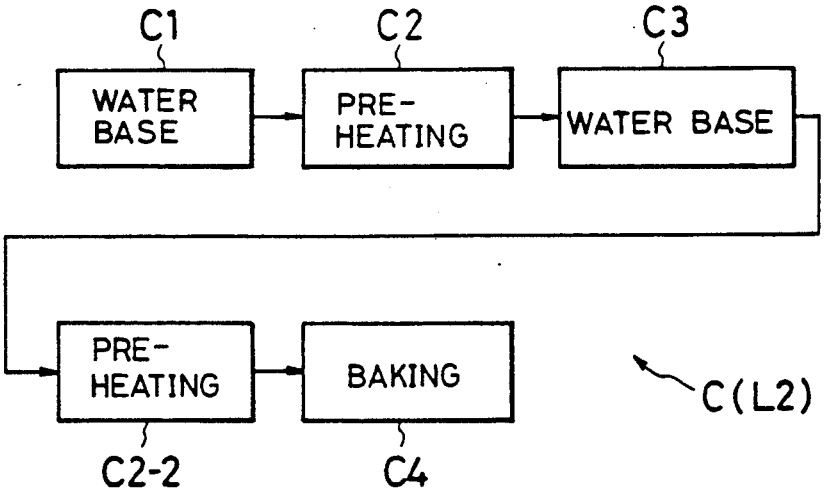
Figure 1C:
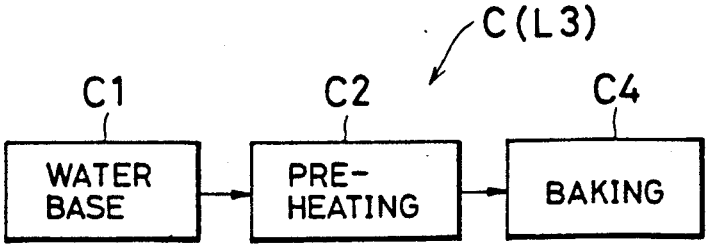

The overcoating step C comprises a line L1 (as shown in FIG. 1A), a line L2 (as shown in FIG. 1B), and a line L3 (as shown in FIG. 1C).

As shown in FIG. 1A, the line L1 comprises a base paint coating step C1 for coating a water base paint, a pre-heating step C2, a clear paint coating step C3 for coating a clear oil base paint, and a baking step C4. The substrate W such as a vehicle body is conveyed step-to-step by conveying means at an appropriate speed (for example, 4 meters per minute).

Figure 2A:
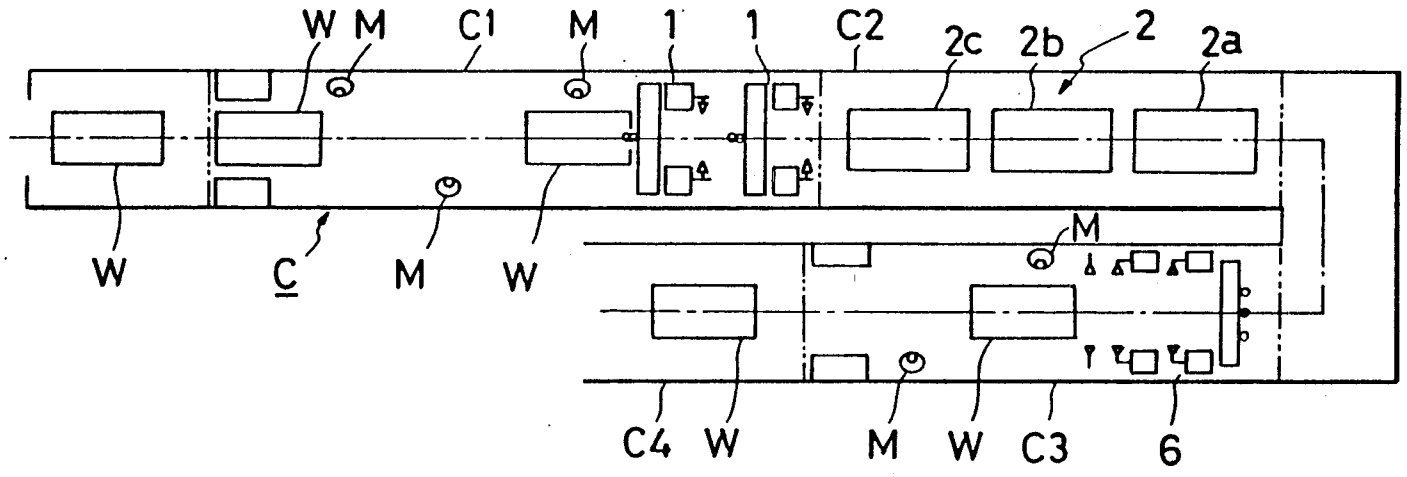
FIGS. 2A and 2B are each a plan view of the coating line to which the present invention is applicable.

As shown in FIG. 2A, the base coating step C1 enables an automatic coating by two automatic coating devices 1 and 1 and a manual correction coating by a worker M.

In the base paint coating step C1, a substrate W to be coated with a water base paint (metallic or solid) and a substrate W to be coated with an oil base solid paint are conveyed in a mixed state. The automatic coating devices 1, 1 are designed so as to selectively coat the substrate with the water base paint or with the oil base solid paint.

The pre-heating step C2 is provided with three pre-heating devices **2*a*, 2*b*, and 2*c*, which are designed such that the water and solvent contained in a coat formed on a surface of the substrate W from the water base paint or in the oil base solid paint can be removed off in appropriate amounts. The pre-heating devices 2*a*, 2*b*, and 2*c*** are disposed so as to be turned ON and OFF as will be described hereinafter.

They are designed so as for each to correspond to a length which accounts for a full length of one substrate W and they are further disposed so as to allow each of the pre-heating devices to pre-heat only one substrate W separately and independently from the others.

The clear paint coating step C3 is to coat a clear oil paint by means of an automatic coating with an automatic coating device 6 and a manual correction coating by the worker M.

In the baking step C4, the base paint coated in the step C1 and the paint coated in the step C3 are baked to a sufficient level of dryness, thereby forming a final overcoat.

As shown in FIG. 1B, the line L2 is provided with an additional pre-heating step C2-2 between the clear coating step C3 and the baking step C4 in order to deal with the coating with a clear water base paint. The steps C1, C2, and C4 are substantially the same as in the line L1.

In the line L3 as shown in FIG. 1C, the line L3 is not provided with the clear paint coating step C3 as shown in FIG. 1A. This line adopts a so-called one-coat/one-baking type, in other words, the line is of the type in which one kind of a paint is coated and the resulting coat is baked.

PAINTS

Paints to be used for the line L1, L2 or L3 may include various kinds of paints. The following is some examples to be applicable to the present invention.

A. Water Paints

Water paints may include, for example, the following as referred to herein as PWB-1, PWB-2 and PWB-3.

(1) PWB-1

PWB-1 is of a so-called a metallic, water base paint which can be used in the coating step C1 in the line L1 or in the line L2. PWB-1 has the following composition (represented in parts by weight):

| | |
|---|---|
| Water base, acrylic resin varnish (NV 30%) | 125.0 |
| Resinous microgel solution (content of microgel: 20%) | 12.5 |
| Hexamethoxymethylmelamine (NV 100%) | 12.5 |
| Aluminum paste (Al content: 20%) | 11.5 |
| 20% Aqueous solution of dimethylamino ethanol salt of p-toluene sulfonate | 1.0 |

-continued

| | |
|---|---|
| Deionized water | 105.0 |

In this example, the water base, acrylic resin varnish may include, for example, any water base varnish obtainable by copolymerizing methyl methacrylate, butyl acrylate, 2-hydroxyethyl methacrylate and acrylic acid and neutralizing the resulting copolymer.

(2) PWB-2

PWB-2 is of a so-called water base, solid type which can be used for the coating step C1 of each of the lines 1 to 3, or for the coating step C3 in the line L2. PWB-2 has the following composition (represented in parts by weight):

| | |
|---|---|
| Acrylic resin (NV 50%) | 80.0 |
| Melamine resin (SYMEL 303) | 20.0 |
| White pigment (TAIPEK R-930) | 70.0 |
| Solvent (Butyl diglycol) | 8.0 |
| Ion exchanged water | 204.0 |
| Additive (Silicone-type surface adjusting agent) | 0.2 |

(3) PWB-3

PWB-3 may be used for forming a clear coat in the coating step C3 in the line 2. PWB-1 has the following composition (represented in parts by weight):

| | |
|---|---|
| Acrylic resin varnish (NV 50%) | 80.0 |
| Melamine resin (SIMEL 303) | 20.0 |
| Solvent (butyl diglycol) | 8.0 |
| Water (ion exchanged water) | 204.0 |
| Additive (silicone-type surface adjusting agent) | 0.2 |
| Sulfonic acid-type acid catalyst | 1.5 |
| Ultraviolet rays absorbing agent | 1.0 |
| Solvesso 100 (Exxon | 24.0 |

B. Clear Paints

Clear oil base paints to be used in the clear paint coating step C3 in the line L1 may include, for example, two paints as referred herein as POC-1 and POC-2.

(1) POC-1

POC-1 has the following composition as represented in parts by weight.

| | |
|---|---|
| Acrylic resin varnish (NV 50%) | 70.00 |
| n-Butyl etherized melamine | 25.00 |
| Acrylic additive | 0.15 |
| Silicone-type additive | 0.02 |
| Ultraviolet rays absorber | 1.00 |
| Solvesso 100 (Exxon) | 17.00 |
| Solvesso 150 (Exxon) | 7.00 |

In this example, the acrylic resin varnish may include, for example, any varnish obtainable by copolymerizing styrene, n-butyl methacrylate, lauryl methacrylate, 2-hydroxyethyl methacrylate and acrylic acid.

(2) POC-2

| | |
|---|---|
| Acrylic resin varnish (NV 60%) | 80.00 |
| Methyl etherized melamine (NV 100%) | 20.00 |
| Acrylic additive | 0.10 |
| Silicone-type additive | 0.02 |

Clear water base paints, on the other hand to be, (3) OSP

An oil base solid paint (OSP) may be used in the coating step C1 or C3 in each of the line L1, L2, or L3, and it has the following composition:

| | |
|---|---|
| Alkyd resin varnish (NV 60%) | 70.0 |
| n-Butyl etherized melamine varnish (NV; 60%) | 16.7 |
| Titanium oxide | 40.0 |
| Carbon black | 0.008 |
| Iron oxide | 0.008 |
| Acrylic additive | 0.2 |
| Toluene | 8.0 |
| Solvesso 100 (Exxon) | 20.0 |
| Solvesso 150 (Exxon) | 12.0 |

The alkyd resin varnish referred to herein contains palm oil, phthalic acid, neopentyl glycol, trimethylol, and propane.

The paints to be used in the coating steps C1 and C3 in each of the lines L1 to L3 may be combined as follows:

(1) For Coating Line L1

When a paint to be used in the coating step C1 is the metallic, water base paint PWB-1, a clear oil base paint, POC-1 or PO2C-2, may be used in the coating step C3.

When a water base solid paint, PWB-2, is used in the coating step C1, too, either of the clear oil base paints, POC-1 and POC-2, may be used in the coating step C3.

(2) For Coating Line L2

When a paint to be used in the coating step C1 is the metallic, water base paint PWB-1, a clear paint, PWB-3, may be used in the coating step C3.

When a water base solid paint, PWB-2, is used in the coating step C1, too, either of the water solid paint PWB-2 or the clear water base paint PWB-3 may be used in the coating step C3.

(3) For Coating Line L3

At this time, the water base solid paint PWB-2 is used in the coating step C1.

PRE-HEATING DEVICE

In the pre-heating step C2 or C2-2 may be used three pre-heating devices 2*a*, 2*b*, and 2*c*. Among them, a portion may be of the type blowing hot or warm air and the rest may be of the far infrared rays type. For example, the pre-heating devices 2*a* and 2*b* may be of the type blowing warm air and the pre-heating device 2*c* may be of the far infrared rays type.

When a water base paint is used, on the one hand, all the pre-heating devices 2*a*, 2*b*, and 2*c* are turned ON. When an oil base solid paint as referred to as OSP above is coated on the substrate, on the other hand, there is conveniently chosen the instance where all the pre-heating devices 2*a*, 2*b*, and 2*c* are turned OFF or where the substrate coated with the oil base solid paint is transferred to the baking step by bypassing the pre-heating devices without passage through the pre-heating step.

In this case, all the pre-heating devices 2*a*, 2*b*, and 2*c* are heated to 40° C. When the pre-heating devices 2*a* and 2*b* to be used are of the type blowing hot air and the pre-heating device 2*c* is of the far infrared type and when the water base paint is employed, the pre-heating devices 2*a* and 2*b* are heated each to 40° C. while the pre-heating device 2*c* is heated to 80° C. This arrangement permits facilitating evaporation of volatile ingredients from the inside of a coat of the water base paint and raising an evaporating velocity.

COATING WITH OIL BASE SOLID PAINT

The following is a description on coating on vehicle bodies W with the oil base solid paint. Table below shows the relationship of the coating lines and the coating steps for coating the oil base solid paint OSP with control modes for controlling the coat formed on the substrate prior to transfer to the baking step.

TABLE

| Combination | Coating Line | Coating Step for Coating OSP | Control Modes |
|---|---|---|---|
| 1 | L1 | C1 | C2: Bypassing |
| 2 | | C1 | C2: OFF |
| 3 | | C3 | — |
| 4 | | C1, C3 | C2: Bypassing |
| 5 | | C1, C3 | C2: OFF |
| 6 | L2 | C1 | C2: Bypassing<br>C2-2: OFF |
| 7 | | C1 | C2: OFF<br>C2-2: OFF |
| 8 | | C1 | C2: Bypassing<br>C2-2: OFF |
| 9 | | C1 | C2: OFF<br>C2-2: Bypassing |
| 10 | | C1, C3 | C2: Bypassing<br>C2-2: Bypassing |
| 11 | | C1, C3 | C2: OFF<br>C2-2: OFF |
| 12 | | C1, C3 | C2: Bypassing<br>C2-2: OFF |
| 13 | | C1, C3 | C2: OFF<br>C2-2: Bypassing |
| 14 | | C3 | C2-2: Bypassing |
| 15 | | C3 | C2-2: OFF |
| 16 | L3 | C1 | C2: Bypassing |
| 17 | | C1 | C2: OFF |

Figure 2B:
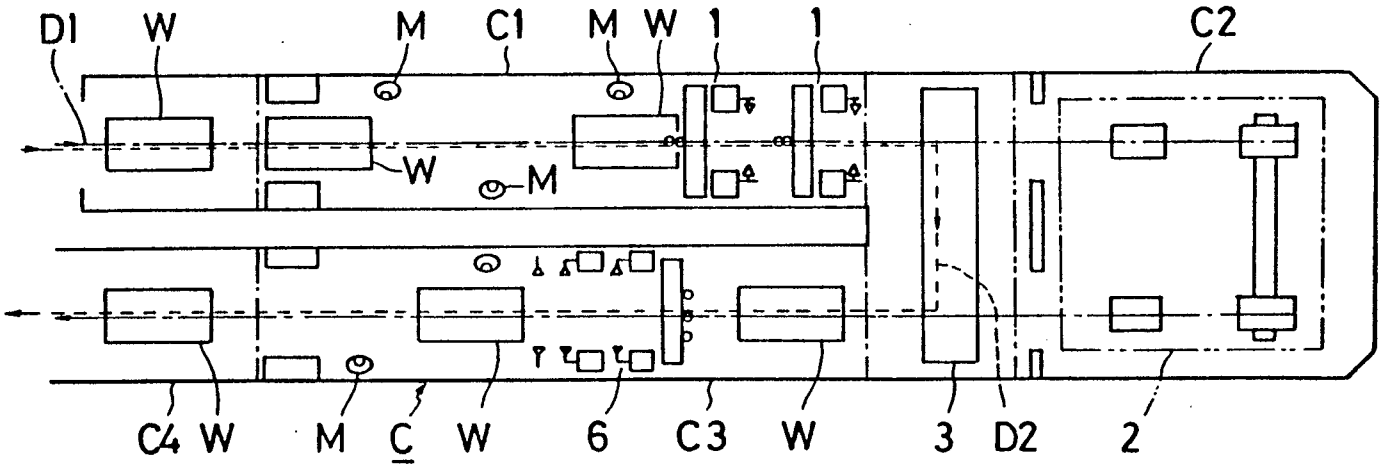

In the Table above, by the terms "C2: OFF" or "C2-2: OFF" is meant a suspension of the pre-heating devices *2a–2c* in the pre-heating step C2 or C2-2 to thereby cause the coat formed on the substrate not to be heated while passing through the pre-heating site in the pre-heating step C2 and C2-2 of the corresponding original coating line. By the terms "C2: Bypassing" or "C2-2: Bypassing" is meant bypassing the pre-heating step C2 or C2-2 of the original coating line without passing the substrate coated with the oil base solid paint OSP through the pre-heating site of the original coating line. Bypassing may be executed as follows:

Referring now to FIG. 2B, a conveyor (chain) D2 is disposed exclusively for conveying vehicle bodies W as a coating substrate which are coated with the oil base solid paint OSP, separately and independently from a conveyor (chain) D1 for conveying vehicle bodies W coated with the water base paint. The conveyor (chain) D2 is further disposed so as to bypass the pre-heating step C2 or C2-2, then leading to the baking step C4.

In order to have the conveyor (chain) D2 bypass the pre-heating step C2, the conveyor D2 may be disposed in common with the conveyor D1 in such a manner that the bodies W are transferred to the conveyor D2 in the downstream of the pre-heating step C2 or C2-2 from the conveyor D1 in the upstream of the pre-heating step C2 or C2-2 by means of a transferring device such as lifters.

PRE-HEATING DEVICES

Figure 3:
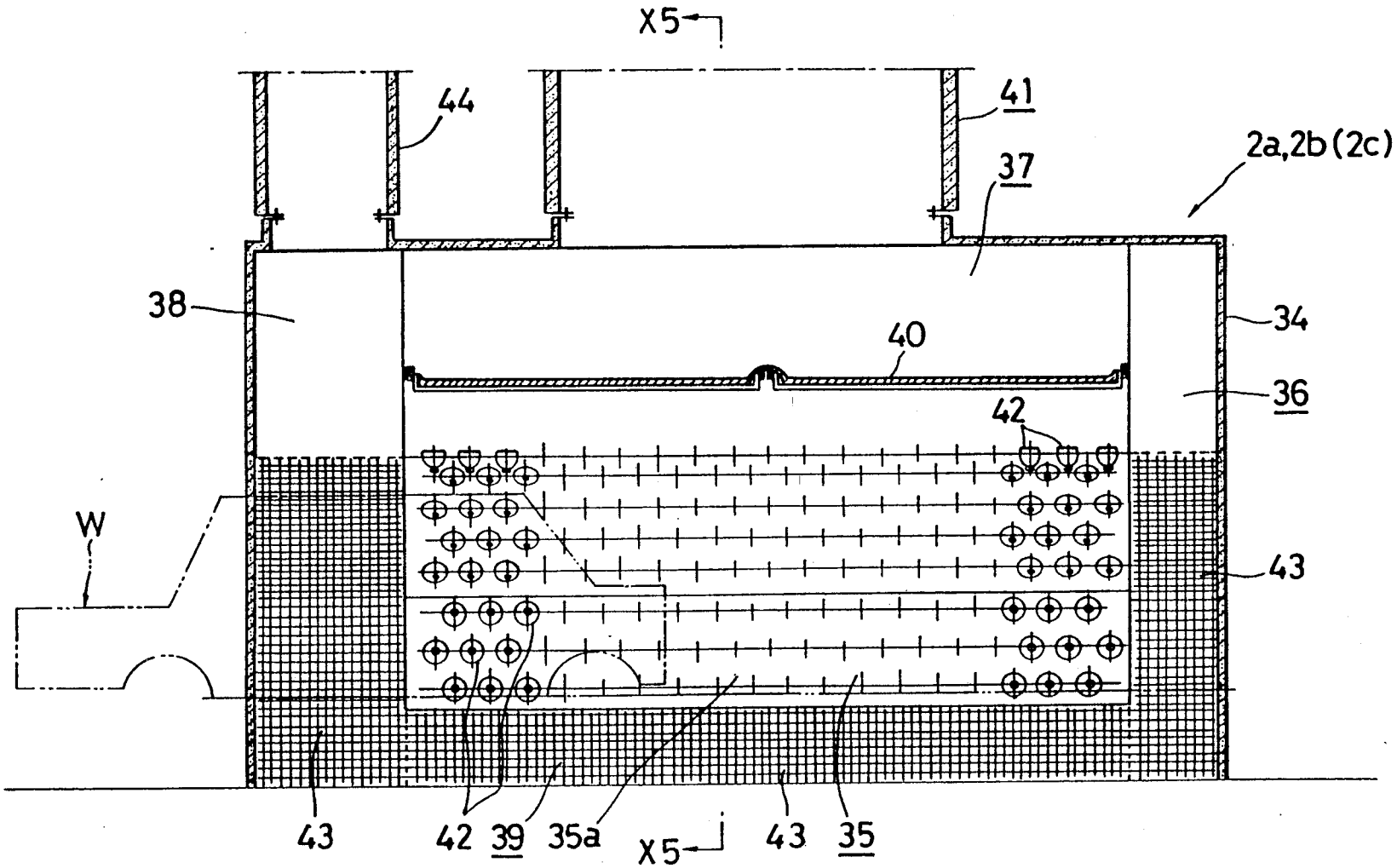
Figure 4:
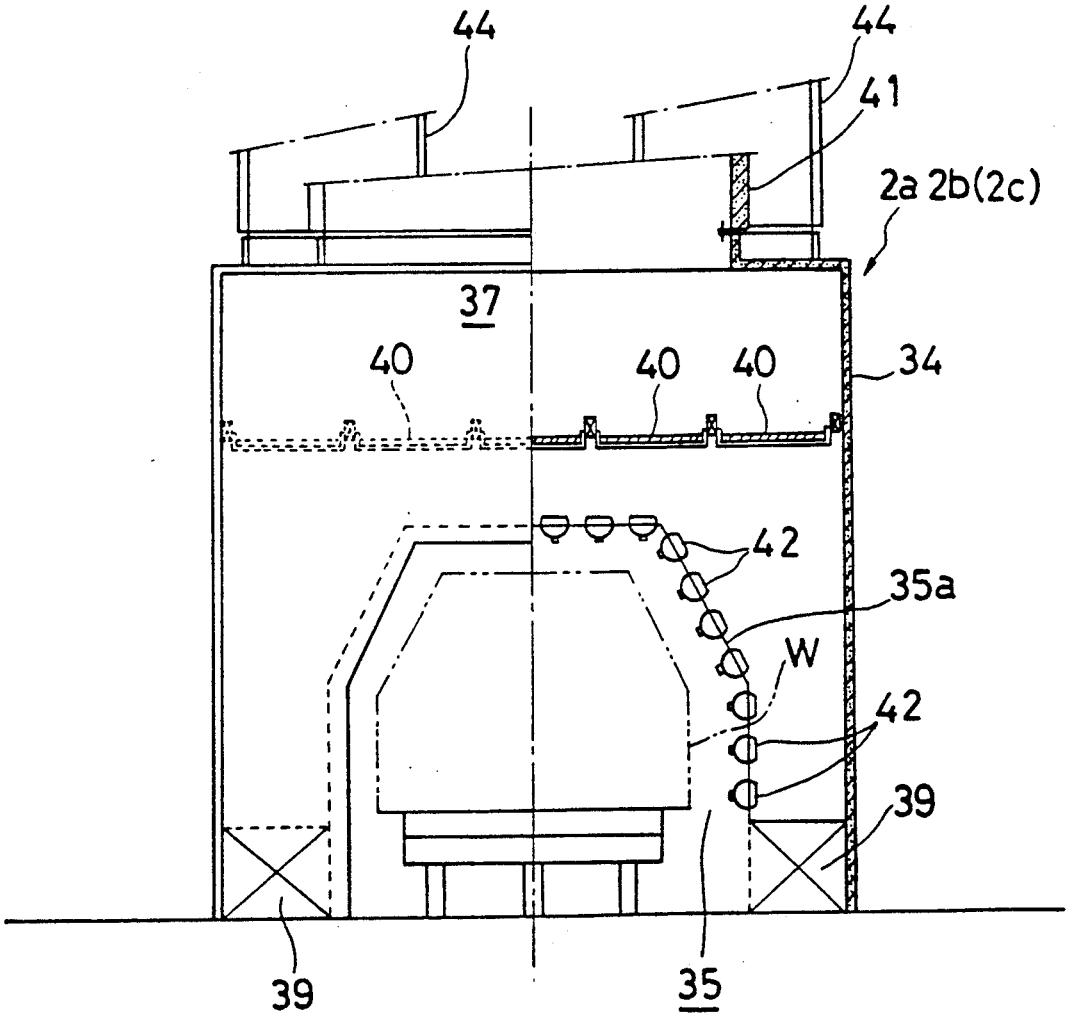
Figure 5:
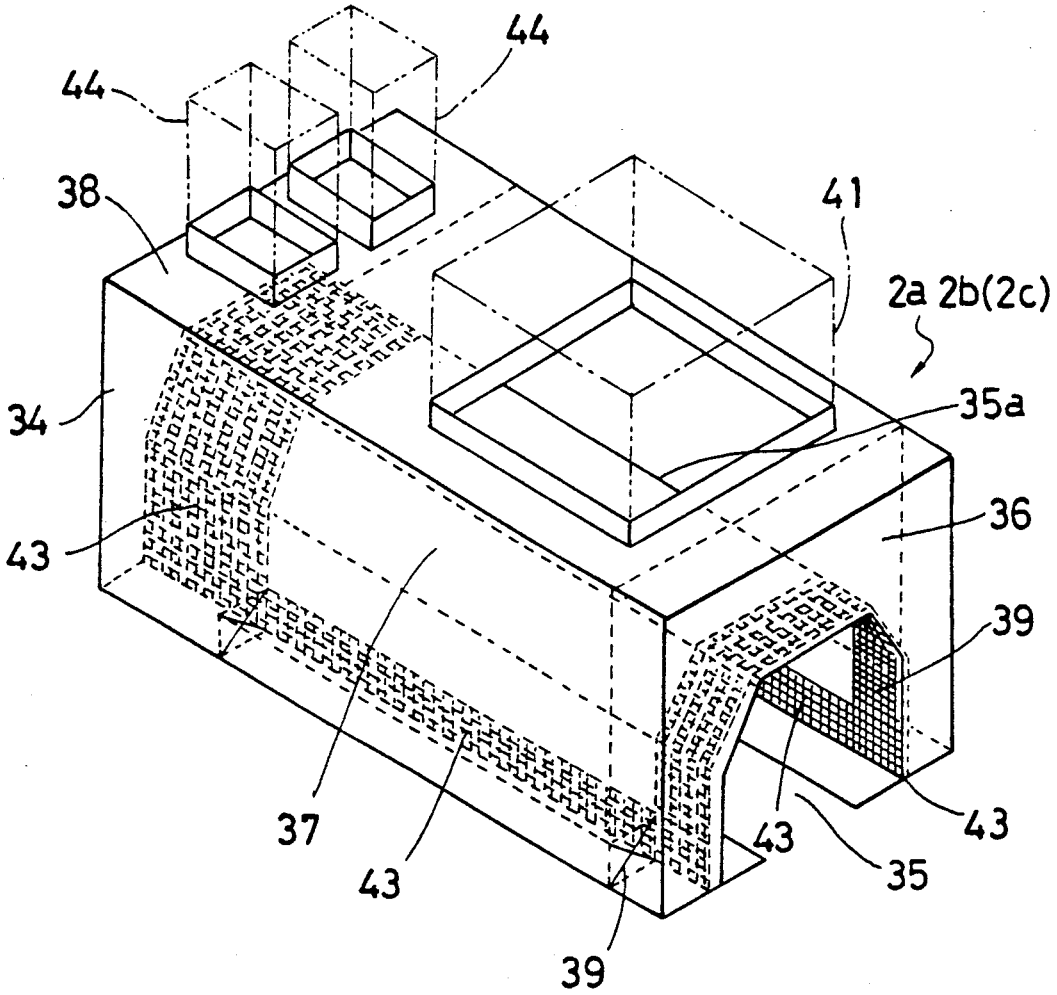

As shown in FIGS. 3 to 5, a description will be made on an example of the pre-heating devices of the type blowing hot or warm air. The pre-heating devices of this type may correspond at least to *2a* and *2b*.

The pre-heating device comprises a main body 34 in an approximately rectangular parallelepided and a drying chamber 35 in the form of a tunnel through which bodies W coated are being passed.

Outside an inner wall 35*a* of the drying chamber 35 in the main body 34 are disposed a first hot air recovering chamber 36, a hot air feeding chamber 37, and a second hot air recovering chamber 38, a first hot air recovering chamber 36 being defined on an inlet side of the main body 34 of the pre-heating device, a second hot air recovering chamber 38 being defined on an outlet side of the main body 34, and the hot air feeding chamber 37 being interposed therebetween. The first hot air recovering chamber 36 is communicated with the second hot air recovering chamber 38 through air passages 39 formed on the both lower sides of the hot air feeding chamber 37.

Figure 8:
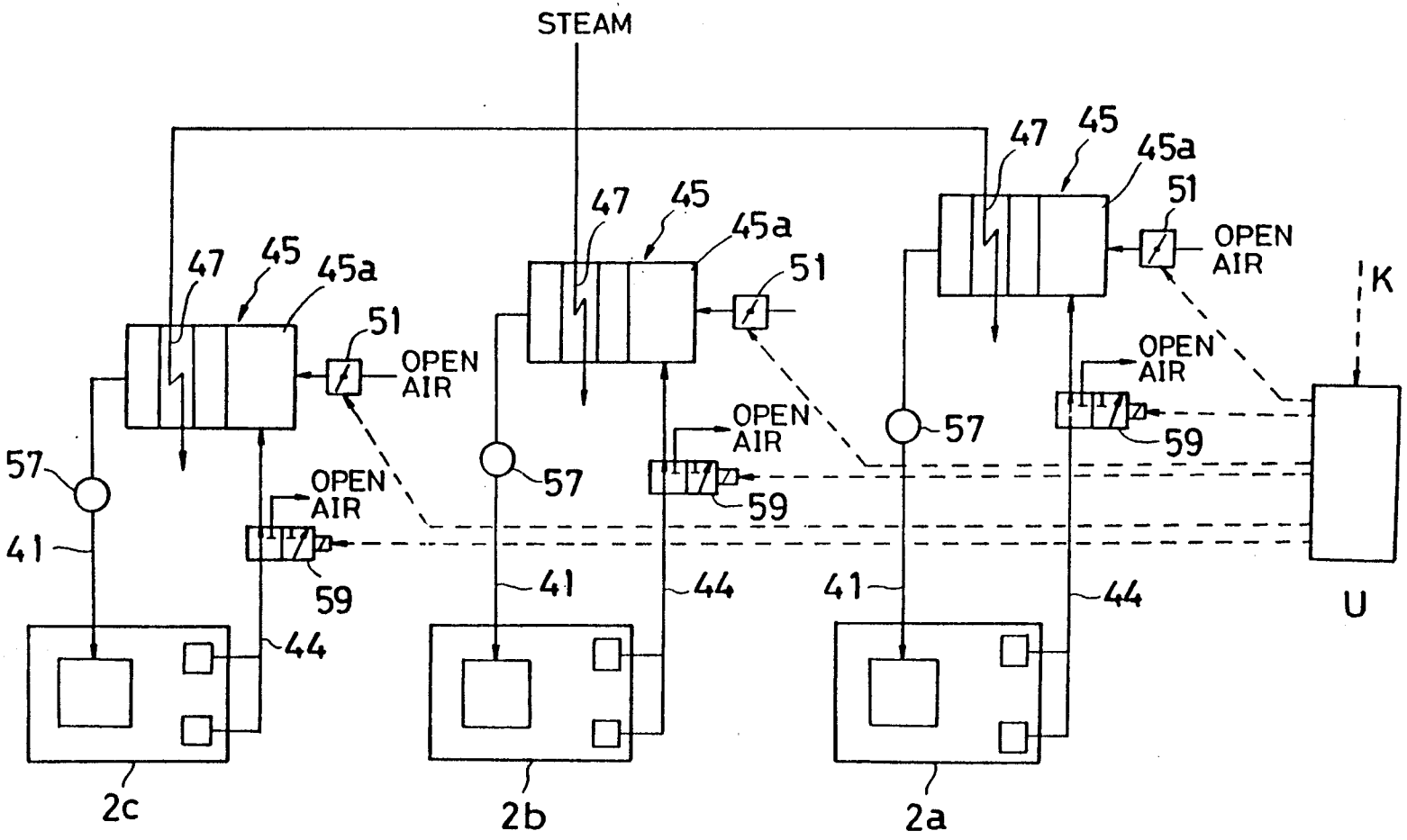
FIG. 8 represents an example of a control system of the pre-heating device.

In the hot air feeding chamber 37 are mounted air filters 40 whose upper surfaces are connected to a hot air feeding duct 41 constituting part of a hot air recycling means 46 as will be described hereinafter, as shown in FIG. 8. The inner wall 35*a* defining the drying chamber 35 and the hot air feeding chamber 37 is provided with a large number of nozzles 42 through which hot air is blown into the drying chamber 35.

The inner wall 35*a* of the drying chamber 35 dividing the first hot air recovering chamber 36, the second hot air recovering chamber 38 and the air passages 39 from the drying chamber 35 serves as a hot air recovering portion 43 constituted by a punch metal. To the second hot air recovering chamber 38 is connected a hot air recovering duct 44 constituting part of a hot air recycling means as will be described hereinafter. The hot or warm air blown from the nozzles 42 into the drying chamber 35 is recovered through the hot air recovering portion 43 into the first and second hot air recovering chambers 36 and 38, respectively, and the air passages 39, thereby permitting a prevention of a leakage of hot air from the drying chamber 35.

As shown in FIG. 8, a hot air generator 45 is interposed between the hot air feeding duct 41 and the hot air recovering duct 44, and a hot air recycling means 46 comprises the hot air generator 45, the hot air feeding duct 41, the nozzles 42, the hot air recovering portion 43 and the hot air recovering duct 44.

The hot air generator 45 is arranged such that hot air recovered from the hot air recovering duct 44 is heated to a given temperature by a heater 47 mounted therein and it is fed to the pre-heating device through the hot air feeding duct 41. To a forward chamber 15*a* of the hot air generator 45 on the side of the hot air feeding duct 41 is connected an outdoor air introducing tube 52 for introducing an outdoor air through a damper 51. The heater 47 is connected to a steam generator (not shown).

In the drawing, reference numeral 57 denotes a fan mounted at an intermediate portion of the hot air feeding duct 11.

To the hot air recovering duct 44 is connected a switching valve 59 which enables hot air recovered from the pre-heating devices *2a*, *2b*, and *2c* to be switched between a recovering state in which the air is introduced into the hot air generator 45 and a withdrawing state in which the air is withdrawn toward the outside.

As shown in FIG. 8, the damper 51 and the switching valve 59 are controlled by means of a control unit U. When the pre-heating devices *2a*, *2b*, and *2c* are all to be turned OFF, the damper 51 corresponding to each of the pre-heating devices 2a, 2b, and 2c is closed and the switching valve 59 is brought into such a released, or withdrawing state as withdrawing the hot air into the outside. Furthermore, the fan 57 may be stopped. In order to implement this control, the control unit U is provided with a vehicle model signal K indicative of a vehicle mode of the vehicle to give data on which paint is coated, water base or oil base.

Figure 6:
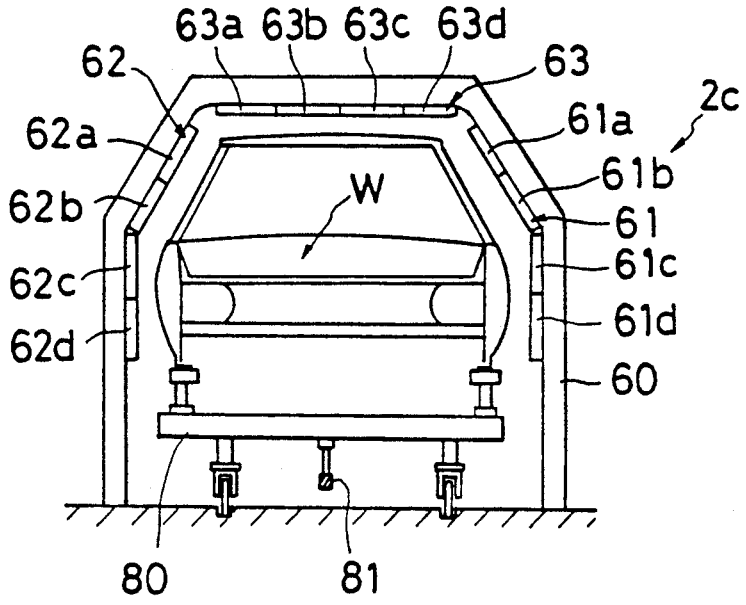
Figure 7:
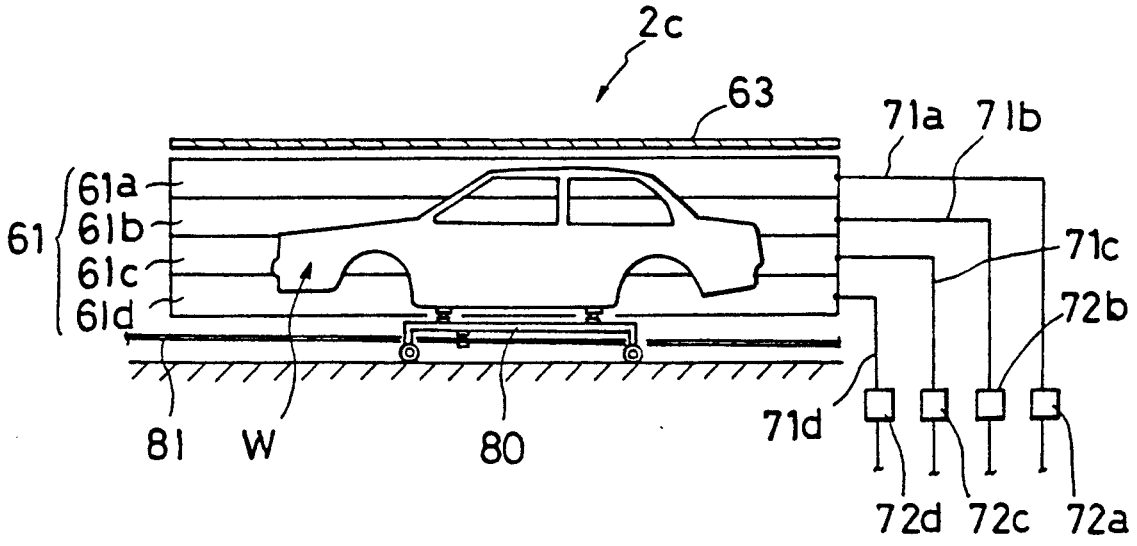

FIGS. 6 and 7 represent an example of the pre-heating device 2c of the far infrared ray type, in which the inner wall of a main body 60 in the form of a tunnel is provided with a heater panel 61 on its left-hand side surface, a heater panel 62 on its upper side surface, and a heater panel 63 on its right-hand side surface.

The heater panel 61 may be divided into four heater panel segments 61a–61d, inclusive, and they are controlled so as to turn on electricity independently from each other. To electric lines 71a, 71b, 71c and 71d of the respective heater panel segments 61a, 61b, 61c and 61d are connected ON/OFF switches 72a, 72b, 72c and 72d. Likewise, the heater panels 62 and 63 may be divided into four heater panel segments 62a–62d and 63a–63d, respectively, and each of the heater panel segments is controlled in an independent manner as have been described hereinabove.

Each of the heater panels 61, 62, and 63 are arranged such that the temperature in the pre-heating device can be heated to 40° C. when two out of the four heater panel segments 61a–61d, 62a–62d, and 63a–63d are turned ON while the temperature within the drying chamber of the pre-heating device can be set at 80° C. when all the four heater panel segments are turned ON.

Figure 9:
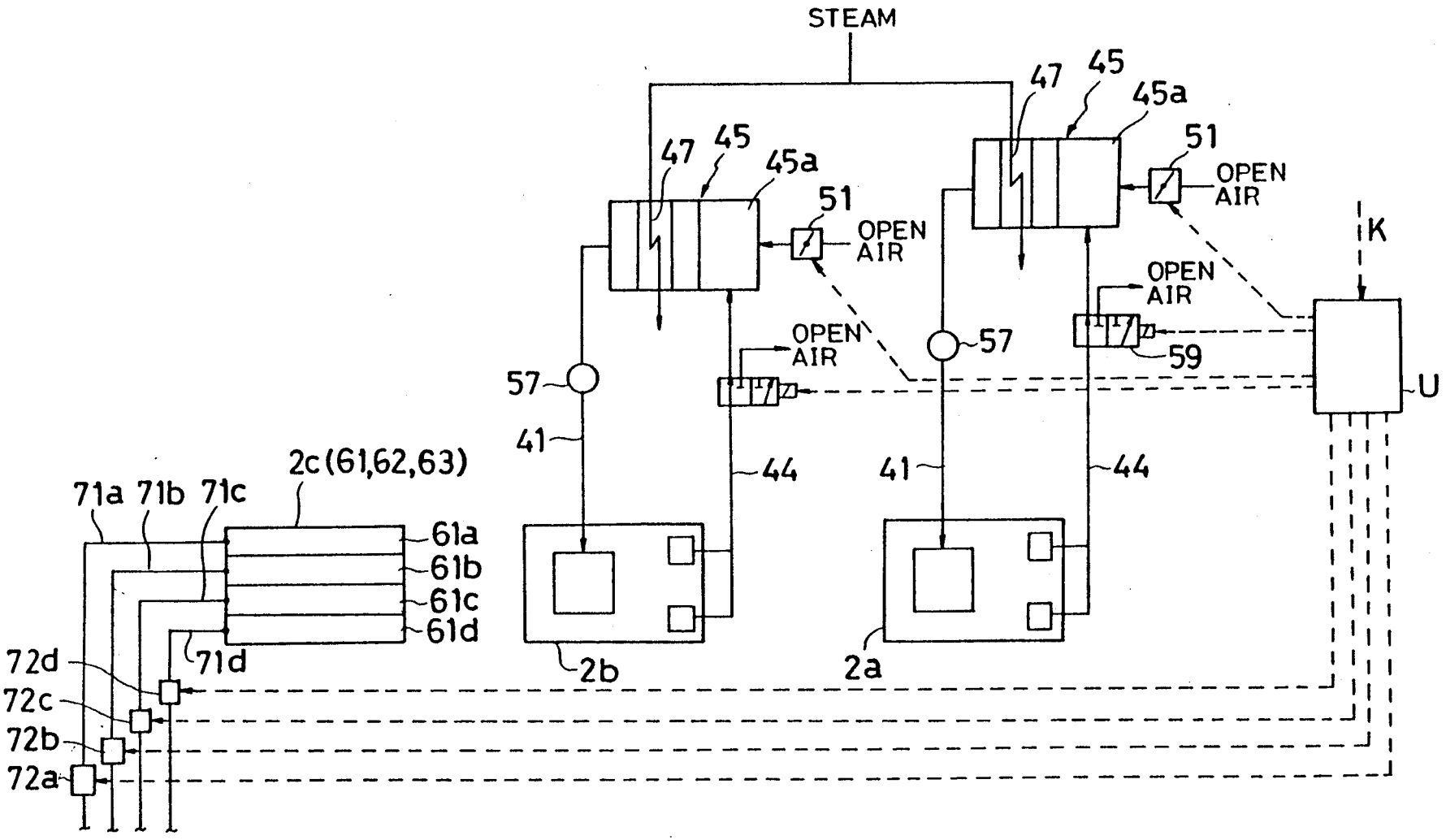
FIG. 9 represents another example of a control system of the pre-heating device.

Turning now to FIG. 9, there is shown a control system when the pre-heating devices 2a and 2b are of the far infrared ray type and the pre-heating device 2c is of the type blowing hot air. The control unit U controls the opening or closing of the switches 72a–72d, inclusive. The same thing can be said of the heater panels 62 and 63.

It is to be understood that the pre-heating devices 2a, 2b, and 2c are all of the far infrared ray type.

It is further to be understood that the foregoing text and drawings relate to embodiments of the invention given by way of examples but not limitation. Various other embodiments and variants are possible within the spirit and scope of the invention.

What is claimed is:

1. A coating method in a coating line comprising:
conveying a plurality of substrates in mixed arrangement on the coating line;
a base paint coating step for forming a water base coat on the substrates by coating the substrates with a water base paint;
a pre-heating step for preheating the water base paint coat;
a clear paint coating step subsequent to the pre-heating step for forming a clear paint coating of an oil base clear paint on the water base paint coat formed on the substrates; and
a baking step for drying the water base paint coat and the clear paint coat by baking;
wherein the oil base paint is coated on the substrates in the clear paint coating step while the substrate to be coated with the oil base solid paint is conveyed on the coating line.

2. A coating method as claimed in claim 1, wherein the oil base solid paint in the clear paint coating step is coated in two stages.

3. A coating method as claimed in claim 1, wherein:
an oil base solid paint is also coated on the substrate in the base paint coating step; and
the substrate coated with the oil base solid paint is then transferred to the clear paint coating step by bypassing the pre-heating step.

4. A coating method as claimed in claim 1, wherein:
an oil base solid paint is further coated on the substrate in the base paint coating step; and
the substrate coated in the base paint coating step with the oil base solid paint is passed through the preheating step in which the heat is turned off.

5. A coating method in a coating line comprising:
conveying a plurality of substrates in mixed arrangement on the coating line;
a water base paint coating step for forming a water base coat on the substrates by coating the substrates with a water base paint;
a pre-heating step for preheating the water base paint coat;
a clear paint coating step subsequent to the pre-heating step for forming a clear paint coating of an oil base clear paint on the water base paint coat formed on the substrates; and
a baking step for drying the water base paint coat and the clear paint coat by baking;
wherein the oil base paint is coated on the substrates in the clear paint coating step while the substrate to be coated with the oil base solid paint is conveyed on the coating line; and
the substrates coated with the oil base solid paint are conveyed on the coating line so as to be passed through the preheating step in which the heat is turned off.

6. A coating method as claimed in any one of claims 1 and 5, wherein:
heating in the pre-heating step is executed by hot or warm air.

7. A coating method as claimed in any one of claims 1 and 5, wherein:
heating in the pre-heating step is executed at least by far infrared rays.

8. A coating method as claimed in any one of claims 1 and 5, wherein:
heating in the pre-heating step is executed first by far infrared rays and then by hot or warm air.

9. A coating method as claimed in any one of claims 1 and 5, wherein:
the water paint is a solid paint.

10. A coating method as claimed in any one of claims 1 and 5, wherein:
the water paint is a metallic base paint.

11. A coating method in a coating line comprising:
conveying a plurality of substrates of different characteristics in mixed arrangement on the coating line;
a first coating step for forming a first coat on the substrates by coating the substrates with a first water base paint;
a first preheating step for pre-heating the first coat on the substrates;
a second coating step for forming a second coat by coating the first coat formed on the substrates with a second water base paint coating subsequent to the first pre-heating step;

a second preheating step for pre-heating the second coat on the substrates; and a baking step for simultaneously drying the first and second coats on the substrates by baking;

wherein an oil based paint is also coated on the substrates at least in the first coating step while the substrates to be coated with the oil base paint solid paint are conveyed on the coating line; and the substrates coated with the oil base solid paint are conveyed on the coating line so as to bypass the first pre-heating step and the second pre-heating step.

12. A coating method as claimed in claim 11, wherein:

the oil base solid paint is also coated in the second coating step.

13. A coating method in a coating line comprising:

conveying a plurality of substrates of different characteristics in mixed arrangement on the coating line;

a first coating step for forming a first coat on the substrates by coating the substrates with a first water base paint;

a first preheating step for pre-heating the first coat on the substrates;

a second coating step for forming a second coat by coating the first coat formed on the substrates with a second water base paint coating subsequent to the first pre-heating step;

a second preheating step for pre-heating the second coat on the substrates; and a baking step for simultaneously drying the first and second coats on the substrates by baking;

wherein an oil base solid paint is also coated on the substrates at least in the first coating step only while the substrate to be coated with the oil base paint solid paint is being conveyed on the coating line; and the substrates coated with the oil base solid paint are conveyed on the coating line so as to be passed through the first pre-heating step and the second pre-heating step, in each of which the heat is turned off.

14. A coating method as claimed in claim 11, wherein:

the oil base solid paint is also coated in the second coating step.

15. A coating method in a coating line comprising:

conveying a plurality of substrates of different characteristics in mixed arrangement on the coating line;

a first coating step for forming a first coat on the substrates by coating the substrates with a first water base paint;

a first preheating step for pre-heating the first coat on the substrates;

a second coating step for forming a second coat by coating the first coat formed on the substrates with a second water base paint coating subsequent to the first pre-heating step;

a second preheating step for pre-heating the second coat on the substrates; and a baking step for simultaneously drying the first and second coats on the substrates by baking;

wherein an oil base solid paint is also coated on the substrates in the second coating step only while the substrate to be coated with the oil base paint solid paint is being conveyed on the coating line; and the substrates coated with the oil base solid paint are conveyed on the coating line so as to bypass the second pre-heating step.

16. A coating method in a coating line comprising:

conveying a plurality of substrates of different characteristics in mixed arrangement on the coating line;

a first coating step for forming a first coat on the substrates by coating the substrates with a first water base paint;

a first preheating step for pre-heating the first coat on the substrates;

a second coating step for forming a second coat by coating the first coat formed on the substrates with a second water base paint coating subsequent to the first pre-heating step;

a second preheating step for pre-heating the second coat on the substrates; and a baking step for simultaneously drying the first and second coats on the substrates by baking;

wherein an oil base solid paint is also coated on the substrates in the second coating step only while the substrate to be coated with the oil base paint solid paint is being conveyed on the coating line; and the substrates coated with the oil base solid paint are conveyed on the coating line so as to be passed through the second pre-heating step in which the heat is turned off.

17. A coating method as claimed in any one of claims 11, 13, 15, and 16, wherein:

the first water paint is a metallic base paint.

18. A coating method as claimed in any one of claims 11, 13, 15, and 16, wherein:

the first water paint is a solid paint; and the second water paint is a solid paint.

19. A coating method as claimed in any one of claims 11, 13, 15, and 16, wherein:

the first water paint is a solid paint; and the second water paint is a clear paint.

20. A coating method as claimed in any one of claims 11, 13, 15, and 16, wherein:

the first pre-heating step and the second pre-heating step are heated by blowing hot or warm air.

21. A coating method as claimed in any one of claims 11, 13, 15, and 16, wherein:

the first pre-heating step and the second pre-heating step are heated at least by means of far infrared rays.

22. A coating method as claimed in any one of claims 11, 13, 15, and 16, wherein:

the first pre-heating step and the second pre-heating step are heated first by means of far infrared rays and then by blowing hot or warm air.

23. A coating method as claimed in any one of claims 1, 5, 11, 13, 15, and 16, wherein:

the substrate is a vehicle body.

* * * * *